US005077893A

United States Patent [19]

Mosquera et al.

[11] Patent Number: 5,077,893

[45] Date of Patent: Jan. 7, 1992

[54] METHOD FOR FORMING ELECTRICAL TERMINAL

[75] Inventors: René A. Mosquera, Laguna Niguel, Calif.; Jimmy W. Powell, Sr., Naperville, Ill.

[73] Assignee: Molex Incorporated, Lisle, Ill.

[21] Appl. No.: 674,411

[22] Filed: Mar. 20, 1991

Related U.S. Application Data

[63] Continuation of Ser. No. 412,699, Sep. 26, 1989, abandoned.

[51] Int. Cl.[5] ..... H01R 43/04

[52] U.S. Cl. ..... 29/882; 29/874; 439/871; 439/872; 439/873

[58] Field of Search ..... 29/874, 882, 884; 206/328, 330; 439/422, 492, 871, 872, 873

[56] References Cited

U.S. PATENT DOCUMENTS

| | | | |
|---|---|---|---|
| 4,045,868 | 9/1977 | Ammon et al. | 29/882 X |
| 4,546,542 | 10/1985 | Proud | 29/874 |
| 4,564,258 | 1/1986 | Garretson et al. | 439/492 |
| 4,720,276 | 1/1988 | Takahashi | 29/874 X |
| 4,776,651 | 10/1988 | Paulo | 439/874 X |
| 4,784,623 | 11/1988 | Beck, Jr. | 439/422 X |

*Primary Examiner*—Carl J. Arbes

*Attorney, Agent, or Firm*—Louis A. Hecht; Stephen Z. Weiss; A. A. Tirva

[57] ABSTRACT

An electrical terminal having a portion of a contact section overhanging the plane of the stock is made by a method that does not weaken the terminal by the use of a slot or similar structure. A blank is stamped from sheet metal stock. Portions of the blank including the portion to overhang are formed up from the plane of the stock. At least part of the terminal base is formed up from the plane of the stock. The formed base portion is returned to the plane of the stock to rotate the contact section and move the overhanging portion to its final position.

8 Claims, 5 Drawing Sheets

METHOD FOR FORMING ELECTRICAL TERMINAL

This is a continuation of copending application Ser. No. 07/412,699 filed on 9-26-1989 now abandoned.

FIELD OF THE INVENTION

The present invention relates to a method for forming a terminal suitable for close spacing in an electrical connector.

DESCRIPTION OF THE PRIOR ART

Close contact spacings and high circuit densities are desirable in modern electrical connection systems, including systems for connecting printed circuit board conductors to conductors of other boards or conductors of cables of various types. A common way of making such connections is to use an electrical connector including an insulating housing with a row or rows of cavities containing stamped and formed terminals having U-shaped contact sections for contacting closely spaced electrical conductors. One known contact section includes opposed flexible contact arms defined on the legs of a U-shaped contact section for mating with a row or rows of pins or posts carried by a printed circuit board or by a mating connector. By convention in the field of electrical connectors, the direction of the row is called the east-west direction and the perpendicular direction between rows is called the north-south direction.

If the spacing between posts along the row is small, for example 0.050 inch, there is not enough room between posts to position the contact sections with the legs oriented in the east-west direction. In one type of contact array, the distance between rows in the north-south direction is larger than the east-west contact spacing, and the opposed legs of the contact structure can be positioned in a north-south orientation to take advantage of the additional space. However, this leads to difficulty in forming the terminal.

The terminals are typically made by progressive stamping and forming operations from a strip or web of planar sheet metal stock. At the conclusion of the stamping and forming operations, the individual formed terminals are connected to a carrier strip lying in the plane of and extending in the direction of the length of the stock. This permits the terminals to be handed as a collation rather than as loose parts for further operations such as plating, assembly into housings, termination to other conductors and the like. For efficient manufacturing and assembly procedures, the carrier strip, and thus the plane of the stock, should be in the east-west orientation.

A problem arises when the opposed legs of the contact section are in the north-south orientation while the stock is in the east-west orientation because conventional and relatively simple forming operations cannot be used to form the contact arms. The difficulty is due to the fact that one of the legs overhangs the plane of the stock. Undesirably complex forming steps are required when known methods are used to form and position an overhanging contact element that is spaced from the plane of the stock.

U.S. Pat. No. 4,784,623 discloses an electrical terminal of this type and attempts a solution to the problem of forming such a terminal. That patent discloses a method in which the contact arms connected to opposed legs of a contact structure are initially formed in the east-west orientation with the arms initially in planes perpendicular to the stock. A slot in the terminal between the contact section and the horizontal terminal base permits the contact section with the contact arms to be formed and then displaced or rotated ninety degrees to reposition the contact arms in the north-south orientation. This method has a serious disadvantage because the slot is essential to performing the method. The slot weakens the completed terminal, making it fragile and susceptible to bending during subsequent handling, for example when it is inserted into a connector housing.

SUMMARY OF THE INVENTION

Among the objects of the present invention are to provide an improved method for making an electrical terminal for close contact spacings; to provide a method in which opposed terminal contact arms can be located in a north-south orientation relative to an east-west oriented carrier strip while preserving the strength of the terminal; to provide a method which avoids weakening the terminal with a slot or similar structure; to provide a method that is an improvement over the method disclosed in U.S. Pat. No. 4,784,623; and to provide a method of making a terminal that overcomes disadvantages of methods employed in the past.

In brief, the objects and advantages of the invention are achieved by providing a method of stamping and forming planar sheet metal stock to make an electrical terminal including a terminal base portion lying generally in the plane of the stock and a generally U-shaped contact section connected to the terminal base portion and including a bight portion and a pair of opposed and spaced apart leg portions extending from the bight portion. The bight portion lies generally perpendicular to the plane of the stock, a first of the leg portions lies generally in the plane of the stock and a second of the leg portions lies generally parallel to and spaced from the plane of the stock. The stock is stamped to define a terminal blank including the terminal base portion, bight portion and leg portions all lying generally in the plane of the stock. The blank is formed to make the contact section by leaving the bight portion generally in the plane of the stock, moving the first leg portion and at least part of the base portion to a position generally perpendicular to the plane of the stock and moving the second leg portion to a position generally perpendicular to the plane of the stock and spaced from the first leg portion. The contact section is rotated by returning the base portion generally to the plane of the stock.

BRIEF DESCRIPTION OF THE DRAWINGS

The present invention together with the above and other objects and advantages may best be understood from the following detailed description of the embodiment of the invention illustrated in the drawings, wherein.

DETAILED DESCRIPTION OF THE PREFERRED EMBODIMENT

Figure 1:
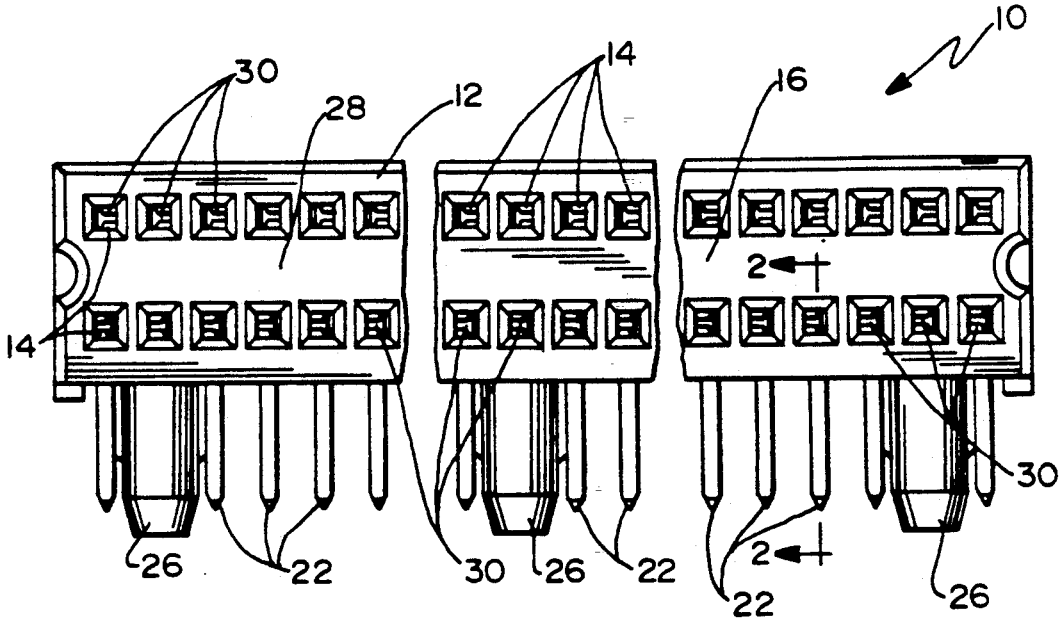
FIG. 1 is a fragmentary end view of an electrical connector including electrical terminals formed by the method of the present invention.
Figure 2:
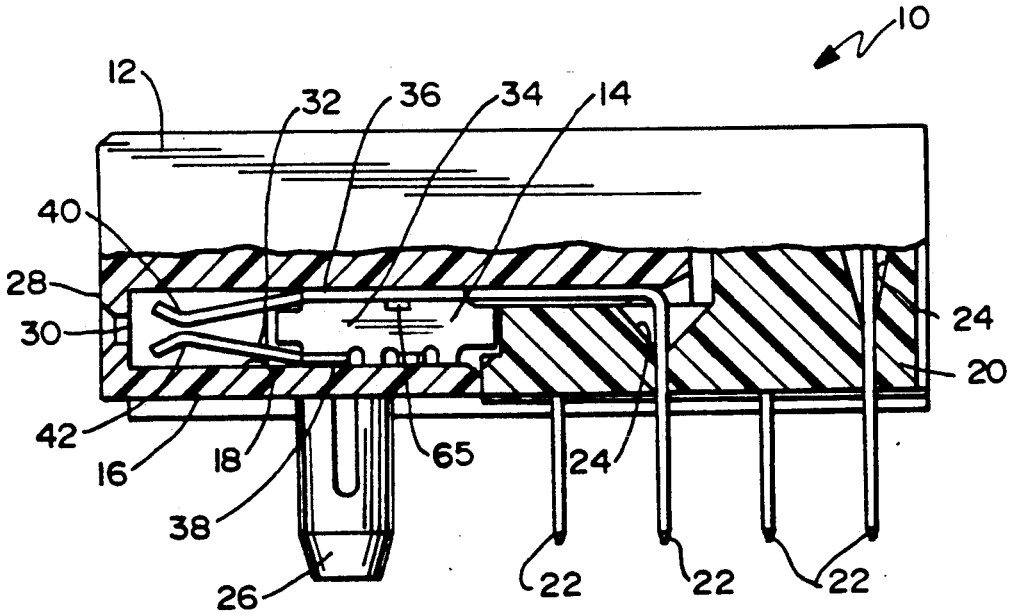
FIG. 2 is a side view partly in section along the line 2—2 of FIG. 1 and on an enlarged scale illustrating one of the electrical terminals mounted within the electrical connector housing.

Referring now to the drawings, FIGS. 1 and 2 illustrate an electrical connector generally designated as 10 including a housing assembly 12 and a number of electrical terminals 14 manufactured by the method of the present invention. The principles of the present invention may be employed in the manufacture of electrical terminals of many different types and such terminals may be employed in electrical connectors of many different types. In the illustrated embodiment of the invention, the electrical connector 10 is a dual row horizontal board-to-board connector.

Housing assembly 12 includes a molded plastic housing 16 within which are defined numerous cavities 18 each receiving one of the terminals 14. A molded plastic tail guide 20 is assembled with the housing 16. Each terminal 14 includes a rear contact pin portion 22 extending downwardly through an alignment opening 24 in the tail guide 20. Positioning posts 26 of housing 16 are received in holes in a printed circuit board (not shown) for mounting connector 10 in a selected position in which pin contacts 22 are connected by soldering to conductive circuit paths on the circuit board.

Cavities 18 communicate with a front wall 28 of housing 16 through pin receiving openings 30. In a typical board-to-board interconnection installation of the connector conductor 10, conductive pins are received through openings 30 and make electrical contacts with the terminals 14. These conductive pins (not shown) may, for example, be connected to conductive paths on a second printed circuit board or may be associated with an electrical connector that mates with the connector 10.

Figure 6:
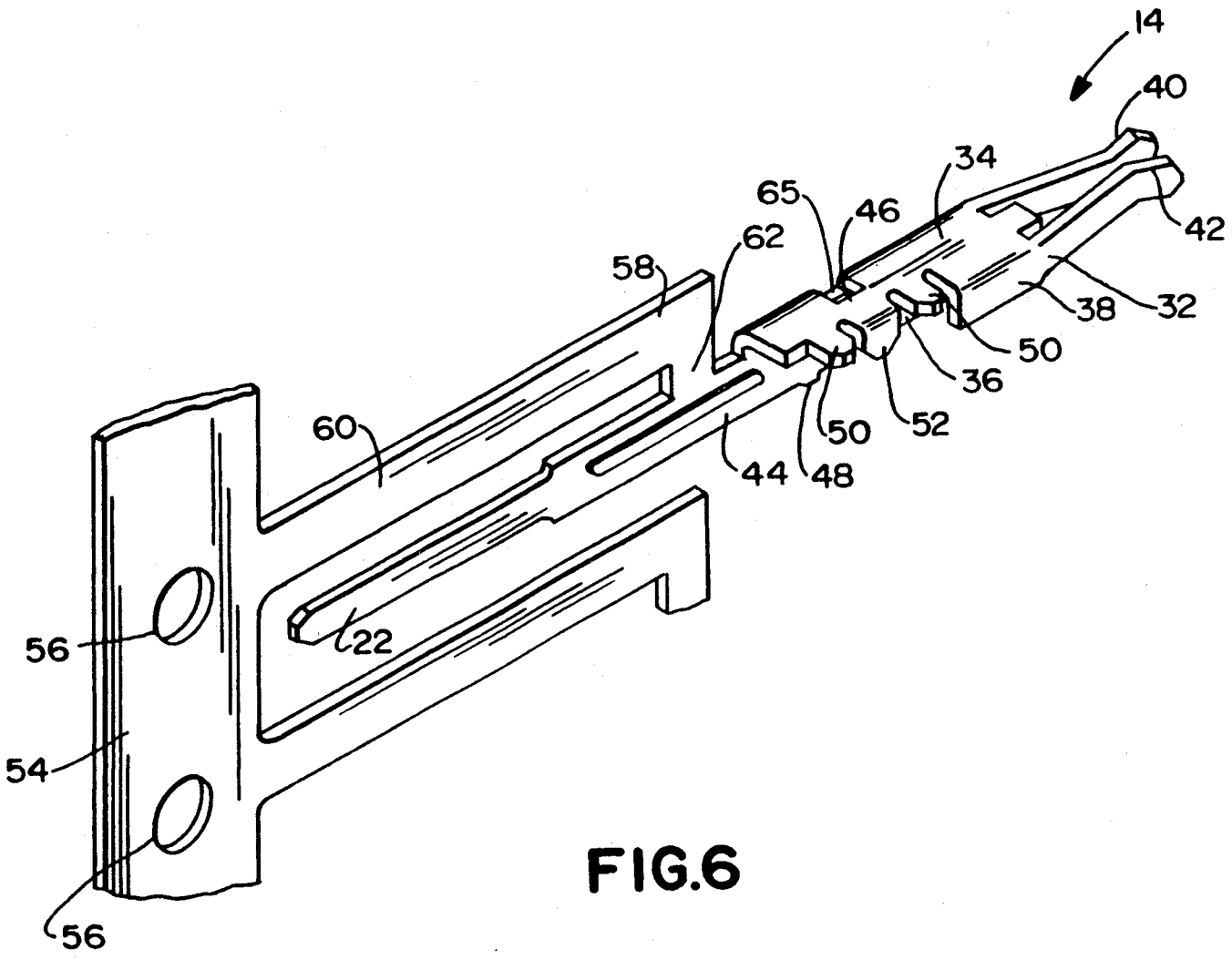
FIG. 6 is a perspective view of the terminal of FIG. 4 at a subsequent point during the method of the present invention.

A forward contact structure 32 is defined on each terminal 14 for making contact with a mated pin terminal. As best seen in FIGS. 2 and 6, the forward contact structure is generally U-shaped with a bight portion 34 and a spaced apart pair of opposed leg portions 36 and 38. Flexible contact arms 40 and 42 extend respectively from the leg portions 36 and 38. When a pin or post terminal is inserted through an opening 30 into cavity 18, the arms 40 and 42 are flexed apart to provide an intimate wiping electrical contact between terminal 14 and the inserted pin.

Connector 10 provides a dense connector centerline contact spacing. Terminals 14 are arrayed in a pair of spaced apart rows. In the illustrated embodiment of the invention, the spacing between terminal centerlines in each row is 0.050 inch. A larger spacing of 0.100 inch is provided between the pair of rows. The length of the rows and the number of rows may be varied in accordance with requirements of the interconnection system, and terminals made in accordance with the present invention can be used with other contact centerline spacings and other types of connectors.

By custom and usage in the electrical connector art, the direction along each row of contacts (the horizontal direction in FIG. 1) is referred to as the east-west direction. The transverse direction between the contact rows (vertical in FIG. 1) is called the north-south direction. As best seen in FIG. 1, the contact centerline spacing is larger in the north-south direction than in the east-west direction.

For optimum functioning of the contact structure 32, it is desirable that the leg portions 36 and 38 as well as the contact arms 40 and 42 be spaced apart or oriented in the north-south direction having the larger spacing. This orientation is best seen in FIG. 2. If the contact structures of the terminals 14 were oriented in the east-west direction, the size of the contact structures would be severely restricted and the performance of the contact structures would be decreased.

A preferred embodiment of the method of the present invention employed in the manufacture of an electrical terminal 14 is illustrated in FIGS. 3–6. Terminals 14 are made from a flat, planar web or strip of sheet metal stock by progressive die tooling in a series of stamping and forming operations. A completed terminal 14 as it exists at the conclusion of the stamping and forming operations is illustrated in FIG. 6.

The completed terminal includes the forward contact structure 32, the rearward pin contact structure 22 and an intermediate terminal base portion 44. A guide flange 46 extends from one side of the base portion 44 and a pair of guide tabs 48 are defined at the opposite edge of the base portion 44. An additional pair of short guide tabs 50 are defined on the edge of guide flange 46 flanking a formed guide finger 52. Flange 46, tabs 48 and 50 and finger 52 cooperate with base 44 in guiding terminal 14 into cavity 18 and holding it in position.

In order to facilitate automated assembly of electrical connector 10, terminal 14 is connected to a carrier strip 54 lying in the plane of the stock from which the terminal is made by the method of the invention. Strip 54 includes a series of indexing openings 56 for positioning terminal 14 during subsequent assembly operations. Base portion 44 is connected to strip 54 by a connecting arm 58 having a first portion 60 extending in the axial direction of the terminal and a second portion 62 extending transverse to the terminal axis. Although not seen in the drawings, a number of terminals 14 may be formed along the length of carrier strip 54. In automated assembly of terminals 14 into electrical connector 10, it is desirable that the carrier strip run in the direction of the terminal rows, the east-west direction. With this arrangement, a large number of terminals 14 can be handled simultaneously.

As a result of the fact that the carrier strip 54 lies in the plane of the stock and extends in the east-west direction in combination with the fact that the legs 36 and 38 and arms 40 and 42 are oriented in the north-south direction, the leg 38 and the arm 42 are generally parallel to and spaced from the plane of the stock in the completely formed terminal of FIG. 6. The present invention provides a way to manufacture this overhanging configuration without extremely complex progressive die operations and without undesirably weakening the terminal 14.

Figure 3:
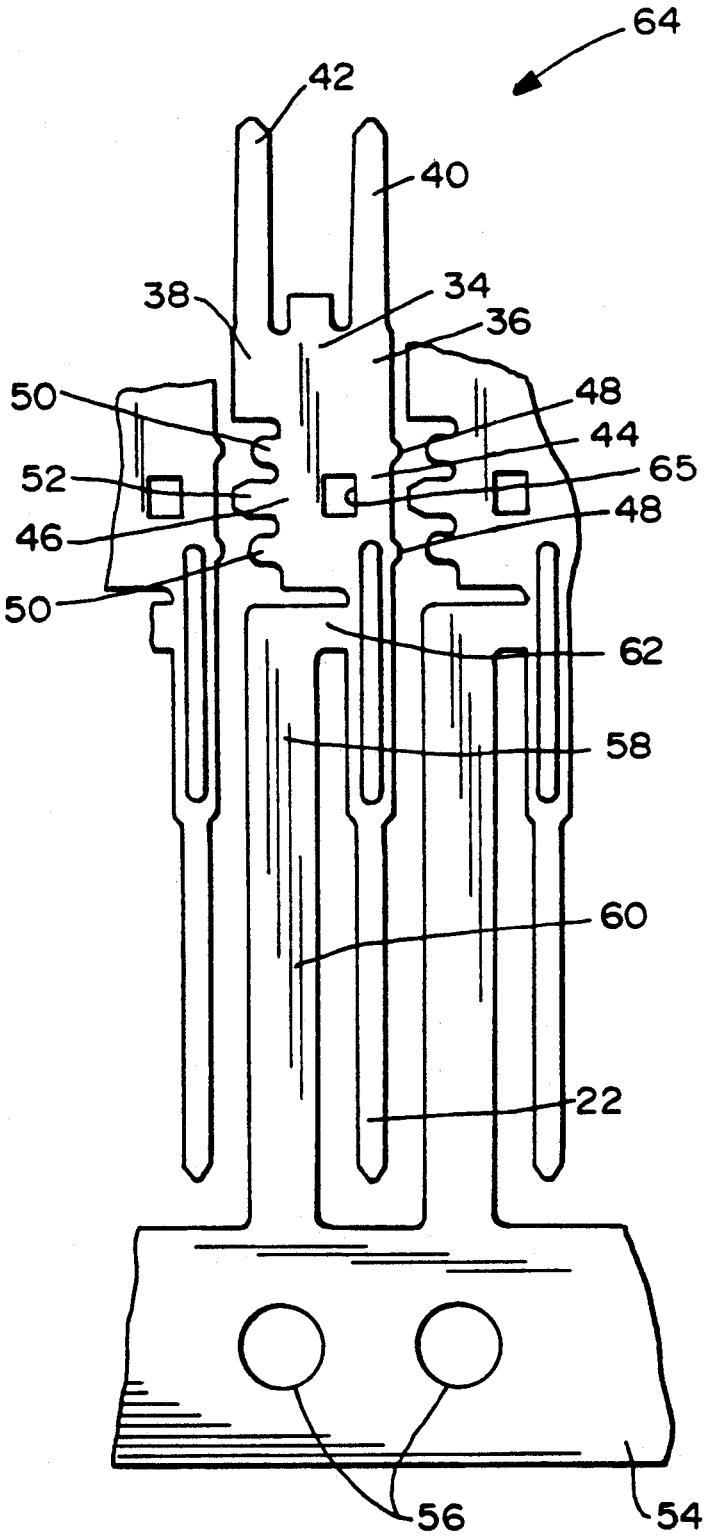
FIG. 3 is a fragmentary plan view of a stamped sheet metal blank subsequently formed to make the terminal of FIG. 2 in accordance with the method of the present invention.

In carrying out the method of the present invention and as seen in FIG. 3, a blank 64 is defined by stamping or blanking the planar sheet metal stock. At this point in the method, all of the elements of terminal 14 in an incipient form are defined in blank 64. All of these elements are in the plane of the stock prior to subsequent forming operations.

Figure 4:
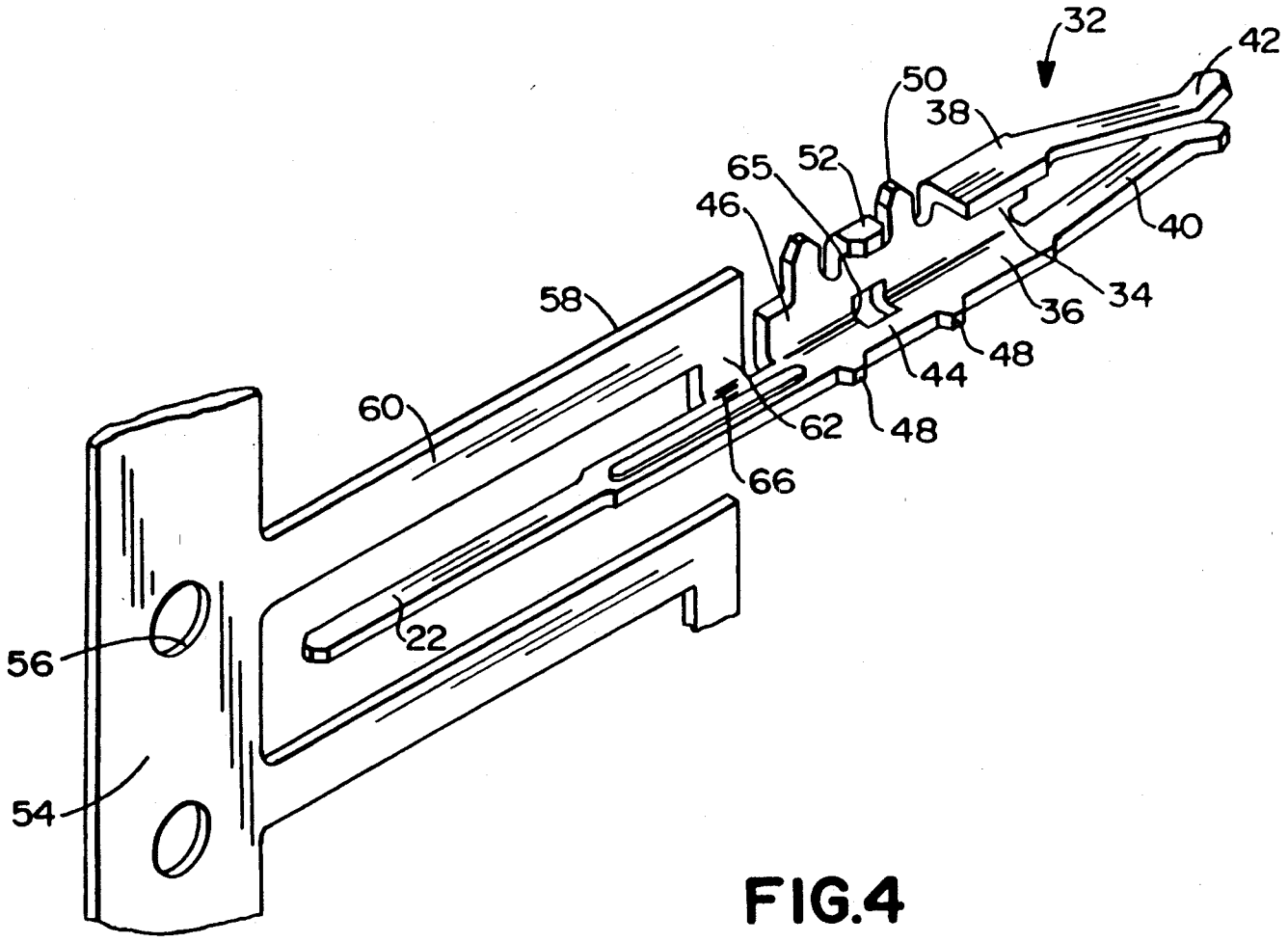
FIG. 4 is a perspective view of the terminal at an intermediate point during the method of the present invention.
Figure 5:
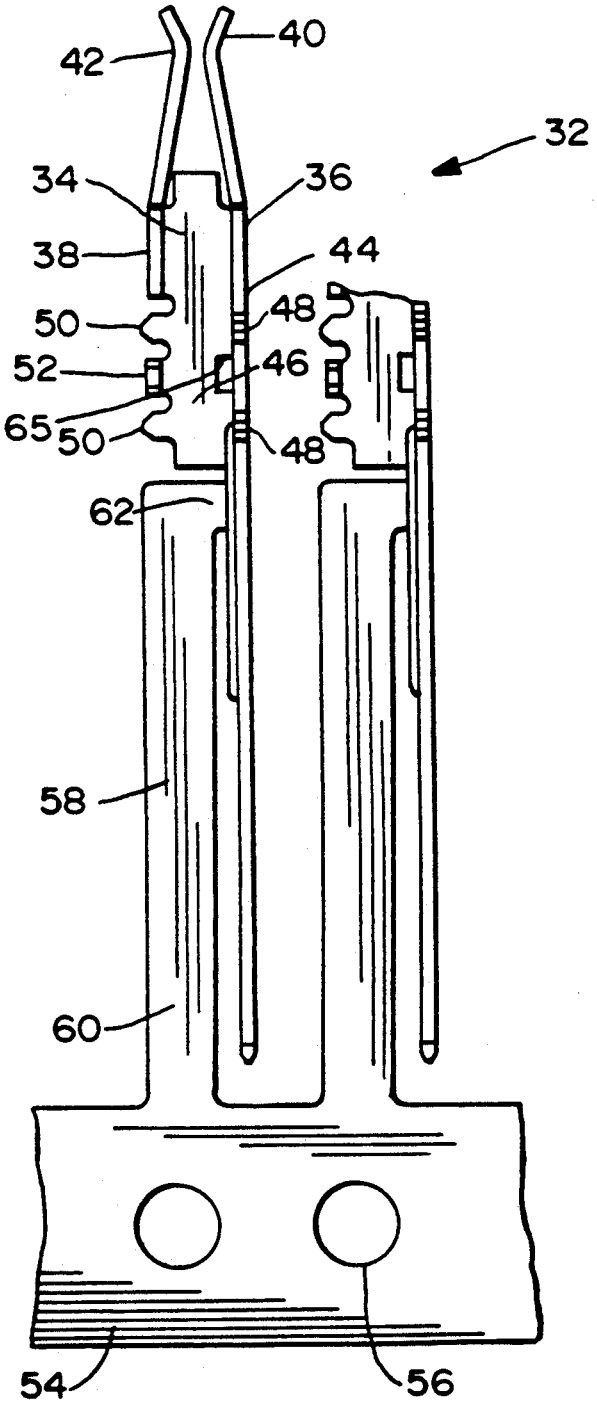
FIG. 5 is a plan view of the partly formed terminal of FIG. 4.

FIGS. 4 and 5 illustrate an intermediate point in the method. Comparing FIGS. 4 and 5 with FIG. 3, it can be seen that at this intermediate stage the elements of the terminal 14 have been formed but that the terminal is not in its final orientation relative to the carrier strip 56 and the plane of the stock. The final shape has been imparted to contact arms 40 and 42 and elements 36, 38, 44, 22 and 52 have been formed up generally perpendicular to the plane of the stock. These forming operations are not difficult or complex because at this point in the manufacture none of the structure of the terminal 14 overhangs the plane of the stock. An aperture or window 65 is formed in the blank 64 in the region where the leg portion 36 and base portion 44 are formed up from the bight portion 34 and guide flange 46. The window permits this region to be formed with moderate force and without cracking or weakening the terminal.

In understanding the method of the present invention it should be noted that at this intermediate stage, the terminal base 44 is integral and continuous with leg 36 of contact structure 32 and that the base 44 and leg 36 are perpendicular to the plane of the stock. Bight portion 34 of contact structure 32 as well as flange 46 are maintained in the plane of the stock along with the connecting arm 58 and carrier strip 54. This intermediate configuration is achieved by forming a ninety degree bend 66 (FIG. 4) in the connecting arm 58 and specifically at the end of the transverse portion 62 adjacent the terminal base 44.

FIG. 6 illustrates the final orientation of the elements of the terminal 14 relative to the plane of the stock and to the carrier strip 54 and connecting arm 58. Here the terminal base 44 and leg 36 are in the plane of the stock, the bight portion 34 and flange 46 are perpendicular to the plane of the stock and the leg 38 is parallel to and spaced from the plane of the stock. Comparing FIG. 6 with FIGS. 4 and 5, it can be seen that the contact section 34 along with the other elements of the terminal 14 have been rotated ninety degrees. In accordance with the method of the present invention, this rotation is accomplished by reforming and flattening the bend 66 that exists at an intermediate stage of the method.

A terminal having a configuration similar to that of FIG. 6 could be manufactured with complex and expensive forming operations. The method of the present invention provides advantages in simplicity and costs savings. A terminal such as terminal 14 manufactured using the method of the present invention is detectably different from a terminal manufactured in accordance with the prior art because examination of the material of the terminal reveals whether or not a bend has been made in the terminal and subsequently flattened in order to rotate the contact structure 32.

Automated assembly procedures are preferably used to load the terminal as seen in FIG. 6 into the housing assembly 12 of the electrical connector 10. In the course of this operation, the pin contact portions 22 are bent and received in the alignment openings 24 of the tail guide 20.

We claim:

1. A method of stamping and forming planar sheet metal stock to make an electrical terminal including the following structure:

a terminal base portion lying generally in the plane of the stock; and a generally U-shaped contact section connected to the terminal base portion and including a bight portion and a pair of opposed and spaced apart leg portions extending from the bight portion, the bight portion lying generally perpendicular to the plane of the stock, a first of the leg portions lying generally in the plane of the stock and a second of the leg portions lying generally parallel to and spaced from the plane of the stock;

said method comprising the following steps:

stamping the stock to define a terminal blank including the terminal base portion, bight portion and leg portions all lying generally in the plane of the stock;

forming the blank to make the contact section by leaving the bight portion generally in the plane of the stock, moving the first leg portion and at least part of the base portion to a position generally perpendicular to the plane of the stock and moving the second leg portion to a position generally perpendicular to the plane of the stock and spaced from the first leg portion; and rotating the contact section by returning the base portion generally to the plane of the stock.

2. A method as claimed in claim 1 wherein the electrical terminal further includes a carrier strip lying generally in the plane of the stock and wherein said stamping step includes defining the carrier strip in the blank.

3. A method as claimed in claim 2 wherein the terminal includes a connecting portion extending between the carrier strip and the terminal base portion and said forming step includes making a bend in the blank adjacent the connecting portion.

4. A method as claimed in claim 3 wherein said rotating step includes flattening the bend.

5. A method as claimed in claim 3 wherein the bend is made at an end of the connecting portion.

6. A method as claimed in claim 1 wherein said forming step includes moving the entire base portion.

7. A method as claimed in claim 1 further comprising forming a resilient contact arm connected to each leg portion.

8. A method of making an electrical terminal from planar metal stock comprising:

stamping the stock to define a blank having a terminal base portion and a contact element that will overhang the plane of the stock;

forming the blank to move the base portion and the contact element up from the plane of the stock; and returning the base portion to the plane of the stock in order to move the contact element to an overhanging position.

* * * * *